United States Patent [19]

Sebalos

[11] 4,265,374

[45] May 5, 1981

[54] PRESSURE LIQUID DISPENSER

[76] Inventor: Adam Sebalos, 3467 Kennedy Blvd., Jersey City, N.J. 07307

[21] Appl. No.: 25,852

[22] Filed: Apr. 2, 1979

[51] Int. Cl.[3] ..... B65D 35/28; B65D 47/00

[52] U.S. Cl. ..... 222/95; 222/105; 222/400.7; 222/397; 222/464

[58] Field of Search ..... 222/94, 95, 396, 399, 222/400.7, 402.1, 402.13, 402.15, 402.18, 105, 397, 464

[56] References Cited

U.S. PATENT DOCUMENTS

| | | | |
|---|---|---|---|
| 2,189,643 | 2/1940 | Ward . | |
| 2,606,698 | 8/1952 | Todd . | |
| 2,666,557 | 1/1954 | Hester . | |
| 2,724,535 | 11/1955 | Day . | |
| 2,823,953 | 2/1958 | McGeorge . | |
| 3,124,281 | 3/1964 | Stull | 222/562 |
| 3,139,123 | 6/1964 | Lisciani . | |
| 3,156,272 | 11/1964 | Indrunas . | |
| 3,244,326 | 4/1966 | Bull . | |
| 3,270,920 | 9/1966 | Nessler | 222/94 |
| 3,315,844 | 4/1967 | Klasson et al. | 222/400.7 |
| 3,325,053 | 6/1967 | Doer et al. | 222/400.7 |
| 3,342,377 | 9/1967 | Peredy . | |
| 3,348,565 | 10/1967 | Turner . | |
| 3,434,632 | 3/1969 | Bartow . | |
| 3,655,102 | 4/1972 | Moran | 222/562 |
| 3,963,063 | 6/1976 | Pascarella . | |
| 4,013,231 | 3/1977 | Van Veldhoven | 222/402.15 |

*Primary Examiner*—H. Grant Skaggs
*Attorney, Agent, or Firm*—Gloria K. Koenig

[57] ABSTRACT

A liquid dispenser for a container which may have a flexible liner for holding liquid, for expelling the liquid therefrom. The dispenser is easily attachable to containers having a common inlet and outlet, and upon depression of a button will permit the liquid in the container to be dispensed from the normally closed dispenser outlet passage. A regulated source of pressurized gas is provided in the dispenser for assisting the flow of liquid if needed, as well as a safety pressure relief valve. The liner can be used when contact of the liquid with the pressurized gas is not preferred or permitted. In that case, the pressurized gas exerts pressure on the liner which forces the liquid out. Another feature is to provide an assembly for facilitating transfer of liquid into the container. This liquid transfer assembly easily connects with the container upon removal of the dispenser, for the smooth transfer of liquid into the container through a funnel-like member and includes an air passage for expelling air within the container prior to filling.

9 Claims, 9 Drawing Figures

PRESSURE LIQUID DISPENSER

BACKGROUND OF THE INVENTION

It is generally known that in order to remove liquid from a container with a singular (i.e. common) inlet and outlet usually at the top, it is generally necessary to lift and tilt the container to dispense the liquid therefrom or to use some other type of pressurized pump arrangement to expel the liquid. Various types of pressurized container arrangements have been used, and typical prior art and discussed below.

U.S. Pat. Nos. 2,189,643 (Ward), 2,606,698 (Todd et al) and 3,348,565 (Turner) generally disclose the concept of providing a suitable stopper or closure for a container which includes a dispensing valve and pressurized source associated therewith. The Ward patent in particular discloses a carbon dioxide capsule situated in the dispense with various valve and inlet assemblies. However, the carbon dioxide is forced directly into the liquid within the container and no flexible liner is provided. The Todd patent discloses a dispenser which uses air pressure from an external source as an aid for dispensing the liquid and further discloses selective opening of a liquid dispensing valve without having to open the air inlet valve or other associated valve simultaneously. The Turner patent discloses a device which fits over a particular type of beer keg closure, such as in FIG. 5, which communicates with the gas and liquid passageways in the beer keg closure.

Prior art which typify the use of a flexible liner between a pressurized gas and the contents of a container includes U.S. Pat. Nos. 2,823,953 (McGeorge), 3,244,326 (Bull), 3,434,632 (Batrow) and 3,342,377 (Peredy). While these patents generally teach the expedient of providing a flexible bag within a container and a pressurized gas source for exerting pressure on the bag together with a suitable dispenser arrangement, the McGeorge patent is of particular interest in that the bag is attached to a dispensing valve situated at the top of the container. The area between the bag and the container is charged with gas via a plug which is situated at the bottom of the container and a valve having a tubular discharge stem communicates with a luquid conducting tube or passageway. Bull discloses a pressure chamber which comprises an expansible bag which expands as beer is dispensed from the container, so that the container is always completely filled by beer and the increasing volume of the pressure chamber. A pressure relief valve system is also provided for venting excessive pressure from the chamber. The Batrow patent discloses still another type of expansible bag filled with gas for maintaining pressure on beer while in a keg to facilitate the expulsion of the beer. Peredy illustrates a dispensing container having a liner wherein propellant gas is provided by a bottom inlet or other suitable external pressurized source. In this patent the internal liner will not collapse under the influence of the pressurized gas.

Prior art patents which are illustrative of liquid transfer assemblies are U.S. Pat. Nos. 2,724,535 (Day et al), 3,139,123 (Lisciani), 3,156,272 (Indrunas), 2,666,557 (Hester) and 3,963,063 (Pascarella). These generally show a variety of different fluid transfer couplings which employ venting and fluid transfer conduits. However, none are associated with a lined container. Day et al automatically fills smaller bottles including liquid and air passageways within a singular tube which is partitioned such that the liquid flows down through one passageway and the air is exhausted through the other during filling. In Lisciani volatile flammable liquid is transferred and the device includes a liquid inlet and vapor outlet with appropriate shut-off valves which are operable when the supply can be inverted. The Indrunas patent is designed for use in filling ketchup bottles and includes an air vent, while Hester discloses a whiskey dispenser wherein when the liquid reaches the air inlet the flow of furhter liquid into the container being filled ceases. Pascarella shows still another device for the transfer of a viscous liquid such as ketchup and mustard.

These prior art patents generally suffer from the disadvantages typical of the prior art in that they do not provide a readily quick and simple method for expelling liquids from a container without the need to lift, tilt or turn the container or to pump it out. The present invention also enables the liquid which is intended to be within the container to be maintained in its proper physical state, as well as suitable arrangement for the transfer of liquid into a container with minimum exposure to the surrounding air.

SUMMARY OF THE INVENTION

The present invention relates to an improved liquid dispenser device and liquid transfer assembly and more particularly, to a liquid dispenser wherein a flexible liner may be employed for containing the liquid and especially adaptable for those containers which have a singular (i.e. common) inlet and outlet for both filling and dispensing of the liquid. The particular liquid transfer assembly provides an easy means for connecting with the container to be filled and enabling smooth transfer of liquid and filling of the container through a funnel-like member, which includes an air passable for the expulsion of air or gas within the container during the filling process.

The present invention comprises an insert assembly to be fitted in the container inlet/outlet opening for cooperation with a dispenser assembly which thereafter is secured to the container inlet/outlet, whereupon liquid is dispensed from the container by activation of a button-like member. Actuation of the button opens the liquid outlet for permitting liquid to flow from the container out through the dispenser outlet. A pressurized source of gas is provided within the dispenser assembly for assisting in expelling the liquid from the container which will not flow without the pressurized source. A suitable relief valve is provided for preventing excessive pressurization of the container in the event that the pressure regulator associated with the pressurized source fails. The flexible liner is fixed to the insert assembly and is useful in preventing contact between the pressurized gas source and the liquid and also in maintaining the desired physical state of liquid. For transferring liquid from one container to another on which the dispenser assembly of the present invention can be utilized, the present invention provides a liquid transfer adapter which couples to the inlet of the containers and smoothly transfers the liquid via a funnel-like member into the container. Any air which may be trapped between the container wall and flexible liner if employed, will be expelled through an air transfer passageway provided in the adapter, which also includes a valve member for preventing liquid from entering into the air outlet passageway.

DESCRIPTION OF THE PREFERRED EMBODIMENTS

Figure 1:
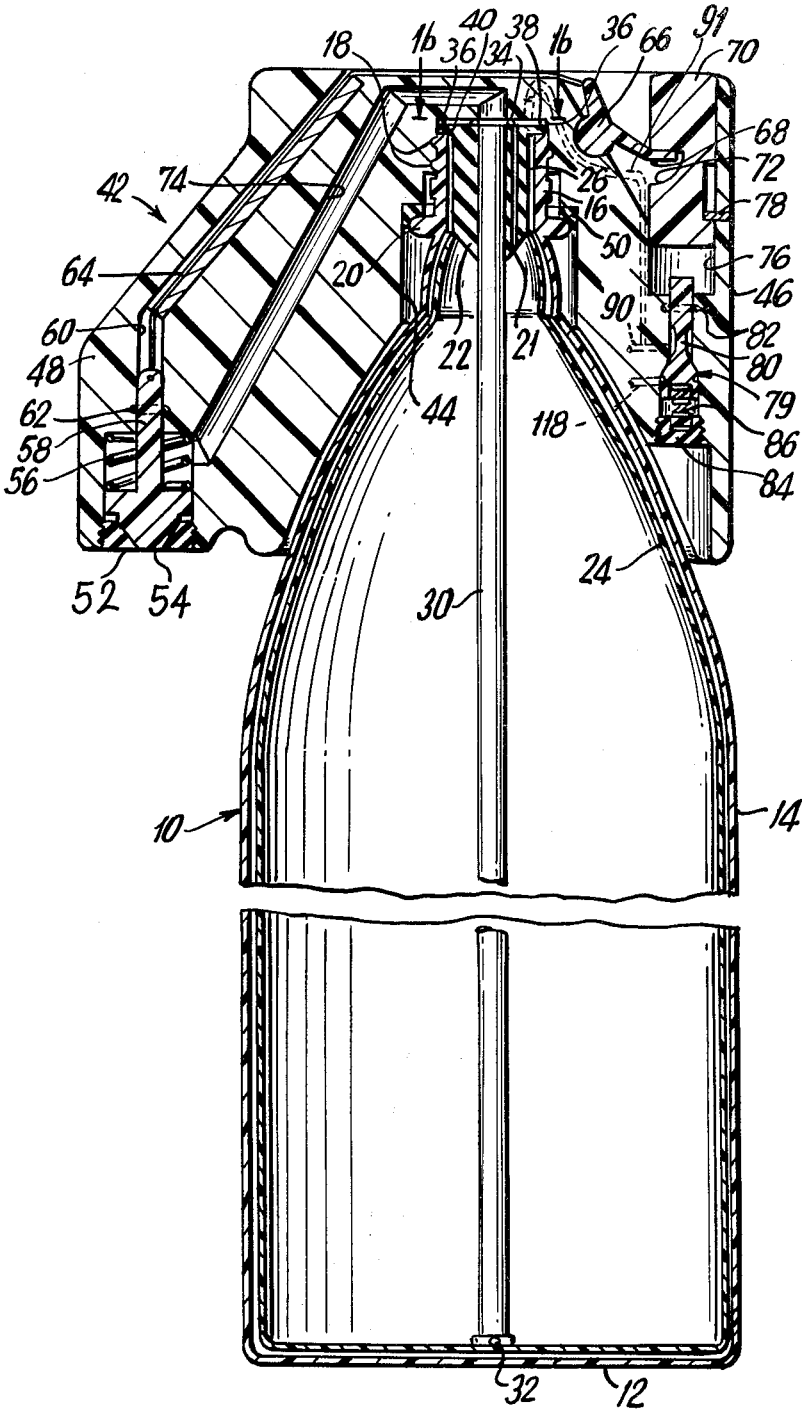
FIG. 1 is a cross-sectional elevational view of a liquid dispenser connected with a liquid container according to the present invention.
Figure 1A:
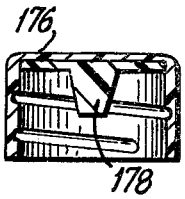
FIG. 1*a* is a side cross-sectional view of a cap for sealing the container when the dispenser is disconnected from the container.
Figure 1B:
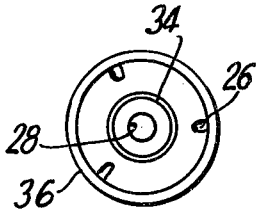
FIG. 1*b* is a top cross-sectional view taken substantially on line 1*b*—1*b* of FIG. 1.
Figure 2:
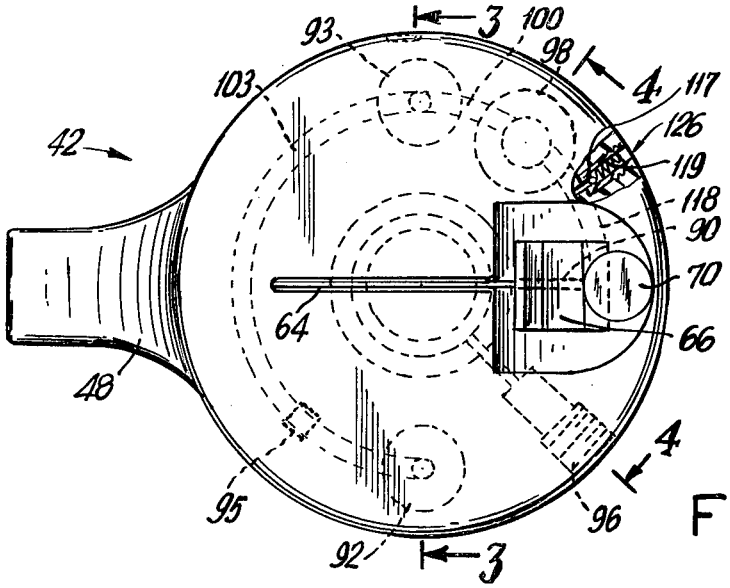
FIG. 2 is a top view in partial section of the liquid dispenser assembly of FIG. 1 illustrating the location of the primary parts and the overall gas flow path.
Figure 3:
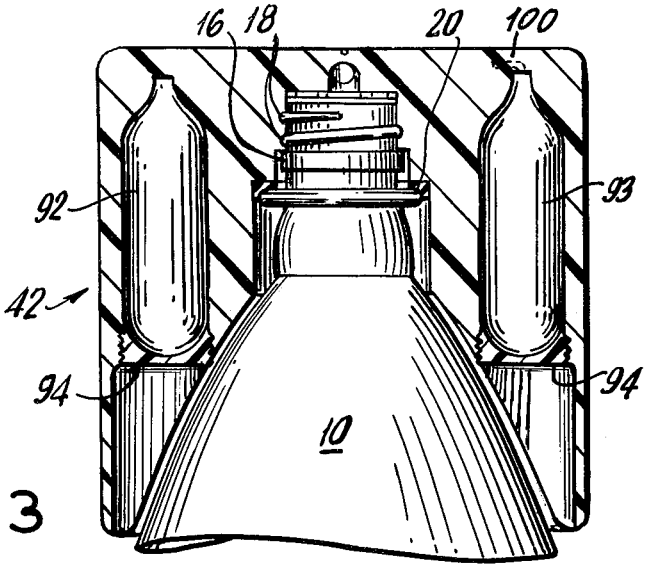
FIG. 3 is a cross-sectional view of the liquid dispenser taken substantially on the line 3—3 of FIG. 2.

Referring now to the drawings wherein throughout the several views like parts are designated by the same reference numeral, there is shown in FIG. 1 a liquid container having a bottom 12, side wall 14 and upper neck portion 16 which is threaded as shown at 18 through which liquid may be inserted and expelled. The neck portion comprises a common inlet and outlet for the container and also includes a lower annular ledge portion 20 extending around the neck. There is provided a plug-like insert stop member 22 which has secured thereto in a suitable fashion such as by heat sealing, a flexible liner 24. The stop has a shape which will generally conform with that of the container inlet/outlet and is made of plastic or rubber. When the plug 22 fits in the container, it is spaced from the container neck so as to define an annular passageway 26 and support the flexible liner which is made of a suitable material such as plastic or rubber, within the container. Centrally of the plug 22 there is provided an opening 28 in which is received and mounted an elongated tubular plastic shaft 30 having at the bottom end thereof an opening 32, the purpose of which is to permit the liquid to flow up into the tubular plastic shaft. While the flexible liner 24 is illustrated in the preferred embodiment, depending upon the type of liquid employed, it may not be necessary for use with the insert plug. Situations in which it would not be required involve liquids such as oils, dyes and juices. Plug 22 has associated therewith, as best shown in FIG. 1, an inner seal such as an O-ring 34 surrounding the central opening on the top surface thereof and a similar outer seal 36 near the periphery of the plug which extends out from the main body of the plug (i.e. the flange 40) into overlying relation with the container neck 16. A further seal 38 is provided on the underside of the extended portion as shown in FIG. 1. The liquid dispenser assembly, generally designated 42, threads onto the container neck 16 after the insert assembly 22 has been put in place, thereby also providing a means for fightening the seal (34). The flange 40 of the plug is disposed between the container neck 16 and the dispenser assembly as illustrated. The dispenser is designed with an interior cavity 44 which mounts over the container neck 16 and has radially extended portions 46, 48 which overlie the container at least in part along the side walls and which include the dispenser components necessary for expelling liquid from the container. At the inner cavity 44 is a support gasket 50 which is disposed between the dispenser and neck bottom flange 20 and compresses as the dispenser is threaded onto the neck, as well as functining to stabilize the dispenser in place on the container. There is provided at the dispenser end or side of the dispenser assembly on a bottom surface an annular seat 52 made of plastic for the liquid explusion plunger 54 mounted in the dispenser assembly outlet, which is spring biased into a normally closed position by means of the helical spring 56 which abuts at one end against the dispenser 42 and at the other end with the surface of the plunger 54 for biasing it into the closed position. The plunger stem 58 extends upward into a passageway 60 and includes an O-ring type seal 62 for preventing any expelled liquid from entering the actuation passageway 60 and is connected at the stem end to a cable 64 which extends through the passageway and is coupled at the other end to a pivotally mounted lever 66 on the opposite actuation side of the dispenser assembly. An extended portion 68 of the lever is disposed for engagement with a depressible buttom 70 which is manually actuatable and accessible from the top of the dispenser assembly. The buttom includes a groove 72 which engages the extended portion 68 of the lever. Upon depression of the button 70, which is normally biased in an upward position, the downward movement of the buttom will pivot the lever 66 clockwise, causing the cable 64 to pull upwardly on the plunger stem 58. This causes the spring 56 to compress and thus place the dispenser assembly outlet in communication with the dispenser outlet liquid passageway 74 provided in the dispenser assembly. Passageway 74 communicates with the central opening 28 (FIG. 1*b*) in the container plug insert 22. The depressible button 70 is guided upon depression in a suitable channel 76 and is prevented from any rotatable movement by the pin-like member 78 which extends through the dispenser main body 46 into engagement with the button and prevents the button from being ejected from the main body. The dispenser assembly channel 76 cavity within which the button is mounted has at the bottom thereof a compartment designed for mounting a gas control valve assembly 79. As shown in FIG. 1, the carbon dioxide control valve pin 80 extends into the button cavity 76 for contact with the button 70 if it is depressed completely down. A seal 82 is provided about the valve pin 80 to prevent the carbon dioxide gas from entering button cavity 76, and at the bottom there is provided a plug 84 which supports a helical spring 86 which biases the valve pin 80 upwardly, such that if the button 70 is depressed downwardly the pin 80 will move against the bias of the spring 86, thus permitting carbon dioxide to be expelled from regulator 98 (FIGS. 2 and 4) via channel 118 (FIG. 1) into the sealed area or compartment containing the valve assembly 79 and outward through the carbon dioxide outlet passageway 90 (FIG. 1). Also provided within the dispenser assembly is a service cylinder 93 (FIG. 3) and spare carbon dioxide cylinder 92 (See FIGS. 2 and 3) which communicate with the pressure regulator 98 for directing carbon dioxide via passageway 118 into the area surrounding the pin 80 and out through the passageway 90 which communicates by an internal passageway 91 between the valve assembly 79 and the space 26 defined between the plug seals, whereupon the carbon dioxide enters into the container between the flexible liner (if provided) and the container, or directly into communication with the liquid contained therein as the case may be. While in preferred embodiment the carbon dioxide may flow from the cylinder to the valve assembly, it is also within the scope of this invention to have the control valve 95 directly associated with the service cylinder 93 such that it will flow directly from the spare cylinder 92 into the service cylinder 93 via passage 103 if desired.

To replace the cylinders, threaded plugs 94 (FIG. 3) which are provided at the bottom of the area of the dispenser assembly which holds the cylinders, can be unthreaded and the cylinders removed and easily replaced.

A pressure relief valve assembly shown at 96 is provided within the dispenser and communicates via a channel 97 (FIG. 4) with the interior of the container for providing an exhaust outlet for pressurized gas to the atomosphere via channel 97 and channel 101. The pressure relief valve assembly 96 also includes a valve plunger 122 which is designed to be normally closed and to move in opposition to the bias of the spring 124. This permits communcation between the interior of the container and the atmosphere via channel 97 and channel 101. The pressure relief valve assembly operates by manually pressing valve plunger 112 on the outside of the dispenser before removing the dispenser assembly 42 from the container, in order to exhaust the gas pressure from the empty liquid container to the atmosphere through the channels 97 and 101. The pressure regulator 98 (FIGS. 2 and 4) which is provided in the dispenser assembly unit has the pressurized gas flow through it via channel 100 and therefrom via the carbon dioxide outlet passageway 118 into the gas control valve 79. This regulator includes upper 102 and lower 104 portions threaded into the dispenser body wherein the upper portion 102 includes a valve plunger 106 designed for being biased into a closed position by spring 110 for sealed engagement with the seat 108. The valve stem engages a diaphram 112 which separates the upper and lower portions at a central location which has extending therefrom a spring 114 which at its opposite end engages a pressure regulator adjustment screw 116 which is accessible from the exterior. By adjustment of the screw, the pressure on the diaphragm can be adjusted. At the top the valve is in communication with a passageway 100 coupled to the service cylinder 93 and directly above the diaphragm is a further passgeway 118 which communicates with gas control valve 79.

Figure 4:
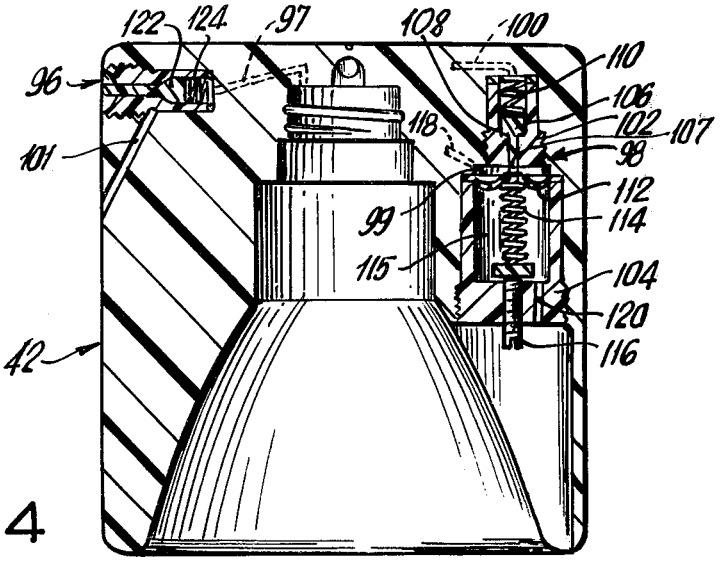
FIG. 4 is a cross-sectional view of the dispenser taken substantially on line 4—4 of FIG. 2.

The regulator, which is standard in the industry, operates such that high gas pressure from the service cylinder enters the upper portion 102 of the regulator 98 via passage 100. Valve plunger 106 is in its normally closed position and gas pressure from the valve service cylinder 93 forces valve plunger 106 into seat 108, whereupon high gas pressure ceases. The upper portion 102 of the regulator 98 is designed so that the normally closed valve plunger stem 107 is in contact with diaphragm 112. A cavity 99 between the upper portion 102 and diaphragm 112 has a passage 118 from it to the button control valve 79. Gas pressure in cavity 99 and passageway 118 is controlled by diaphragm 112 and spring tension from spring 114 in the lower portion 104 of regulator 98 (FIG. 4). The tension on spring 114 can be increased or decreased by adjusting screw 116. Spring tension on spring 114 is increased to the point where it exerts enough force on diaphragm 112 and valve plunger stem 107 to overcome the spring tension from spring 110 on valve plunger 106 to unseat seat 108, allowing high gas pressure to flow past valve plunger 106 and seat 108 into cavity 99 and passageway 118. When the gas pressure in cavity 99 reaches the point where it exerts enough force on diaphragm 112, with the aid of spring tension from spring 110 on valve plunger 106 seat 108 seats, thus closing off gas flow into cavity 99.

A breather port 120 (FIG. 4) is provided in order to allow atmosphere into chamber 115 so diaphragm 112 can flex in response thereto.

A further pressure relief mechanism 126 (FIG. 2) in the form of a safety valve is provided for cooperation with passageway 118 and is of the spring and ball type. The ball 117 is biased in the closed position by spring 119. Excessive gas pressure in passageway 118 unseats ball 117 which allows the gas to exhaust to the atmosphere.

In the event that the liquid does not flow properly, then it is known that additional pressure is required to expel the liquid from the container. Depression of the button 70 completely down will actuate the gas control valve pin 80 which permits the pressurized gas to flow from the service cylinder 93 through the pressure regulator assembly 96 via passage 90. This pressurized gas when applied to the liquid will cause it to flow up through the tube 30 and out through the dispenser passageway 74. As explained previously, the safety relief valve will prevent over-pressurization of the container if the regulator fails. In the event that the liner is employed, then the operation will be basically the same except that gas pressure will be applied to the liner as opposed to being applied directly to the liquid.

Figure 6:
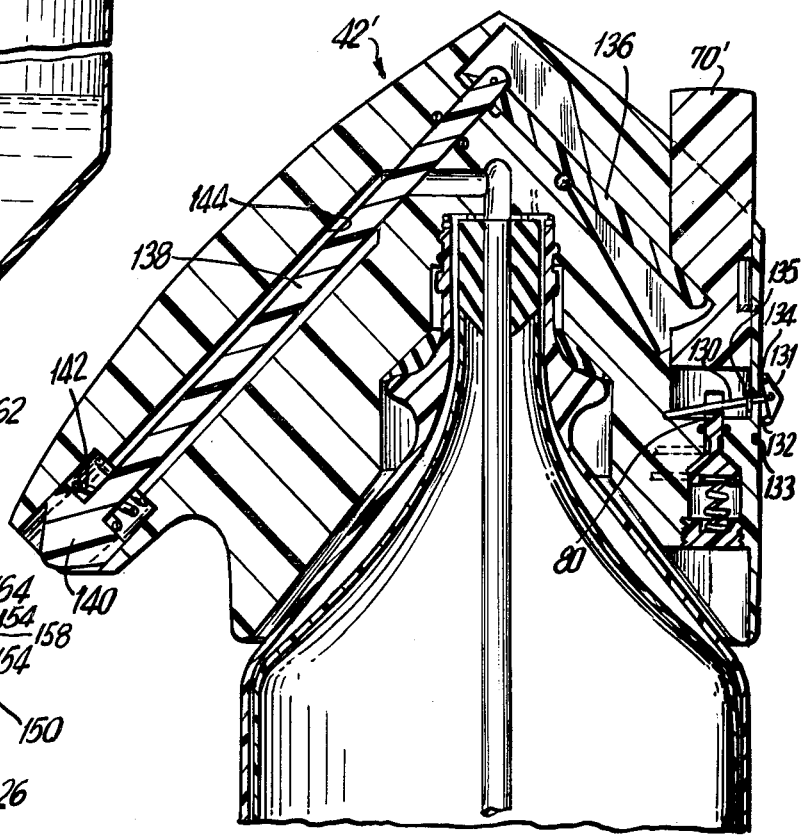
FIG. 6 is an alternate embodiment of the liquid dispenser of FIG. 1 according to the present invention.
Figure 7:
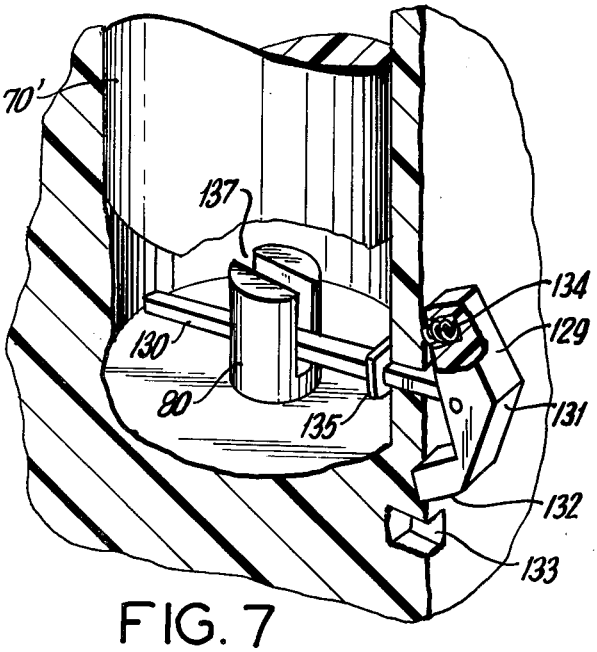
FIG. 7 is a perspective view of the constant pressure switch of FIG. 6.

An alternative embodiment is shown in FIGS. 6 and 7 for use in those instances where the liquid must be kept under a constant pressure in order to maintain the desired physical state or characteristic of the liquid, either with or without the flexible liner. In that case, a controlled on/off switch is provided which can be actuated manually to cause a regulated continuous gas pressure to be exerted on the liquid with or without the liner. The manually actuatable control valve pin 80 can be locked in place in order to provide the desired supply of pressurized gas. The operation is that the downward depression of the button 131 will cause the lever 130 and valve stem 80 to move downwardly and the locking tab 132 on the button 131 will engage the recess 133 for holding it in place. A spring 134 (best illustrated in FIG. 7) is provided in order to urge the button slightly outward. It is maintained in its slidable position on the inside by the rider member 135.

Also shown in FIG. 6 is an alternative embodiment for actuating the liquid expulsion. This includes the provision of slightly modified dispenser assembly configuration 42' in a conical shape having the actuatable button 70' extending upwardly and being disposed in contact with a pivotally mounted lever 136 which at the opposte end is engaged with the elongated stem 138 of the dispenser outlet plunger 140. The bottom end of the plunger includes a conically shaped port closure portion which engages a seat and is normally maintained closed by means of the spring 142. Depression of the button causes the lever to move about its mid-portion urging the opposite end in a clockwise direction, which pulls upwardly on the plunger causing it to move in opposition to the spring bias and opening the liquid outlet port and passageway. The passageway 144 in which the plunger is mounted also provides the outlet liquid passageway for the liquid from the container, thereby having the advantage of minimizing the number of internal passageways within the dispenser assembly. In this embodiment similar portions to the dispenser of FIG. 1 have been illustrated with a prime number and identical components by the same reference numeral.

Figure 5:
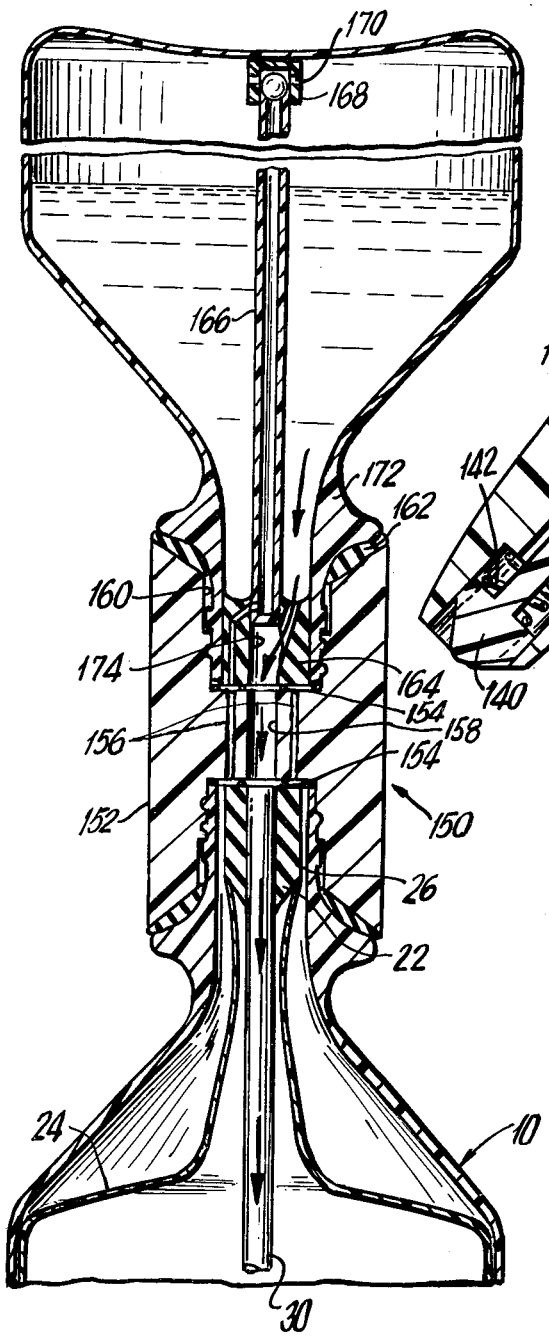
FIG. 5 illustrates a liquid transfer assembly associated with a container constructed in accordance with another embodiment of the present invention.

There will now be described another aspect of the present invention which involves the transfer of liquid from one container into another. Thus, as shown in FIG. 5, there is a liquid transfer assembly 150 comprising a main body 152 which threads onto the neck of the container being filled. At the bottom of the main body is a support gasket 154 and likewise at the top. Within the body are air transfer passageways 156 for releasing air from within the container as the liquid passes through the central channel of the insert plug. Centrally of the body is a liquid transfer passage 158 through which the liquid is poured and communicates with the central passageway of the insert plug 22. The top portion of the assembly includes a cavity 160 which is threaded internally and spaced inwardly therefrom is a portion 162 which aids in supporting the container from which the liquid is being poured and also including further portion 164 which includes an exhaust air conduit 166 for communication with the aforesaid air transfer passageway. The exhaust air conduit 166 includes at its upper end a floating ball and check valve assembly 168 arranged such that as air exhausts through the conduit the ball will be moved upwardly for permitting the air to exhaust through the outlet port 170 into the area of the filled container disposed above the liquid level. The transfer assembly includes at its upper end a funnel-like member 172 which threads into the inner cavity at the top of the transfer main body. This funnel member can be used if desired to pour the liquid through the adapter into the container being filled and from which it will be dispensed. However, the funnel member need not be used and the adapter can be attached directly to a dispensing container for facilitating filling of the container. The liquid from a larger container using the present invention can easily be poured into a smaller container without spillage or difficulty in holding the larger container in a lifted position. Once the adapter is secured to the empty container which has the insert plug in place, either with or without a flexible liner, the funnel including the liquid and air transfer lines is secured in place at the opposite end of the adapter. Liquid flows from the funnel through the passageway 174 into the container via tubular passageways 30 and 158. Any air which is trapped in the container will be forced back through the air transfer passage 156 and up the air shaft 166 and out. Liquid will not enter the air shaft because of the presence of the ball check valve at the upper end thereof.

There may be provided a further passageway 21 (FIG. 1) in the insert plug 22 which would provide a pressure relief for pressures created by carbon dioxide which might be released in the event that liquids of the carbonated type such as, i.e. soda, beer, etc., are stored in the flexible liner. This release of carbon dioxide could result from temperature changes, movement and the like, and the passage which is situated directly under the seal 34 communicates with the area within the liner and is only open to the atmosphere when the liquid dispenser or storage cap is removed. The storage cap 176 shown in FIG. 1*a* includes a central truncated portion 178 which tapers inwardly to form a conical like member and seals the central port of the insert when in place. A cap threads into place and seals off all of the passages previously described for the insert plug and when the cap is removed, initially air and gas will be released to the atmosphere through the passages 21. As it is twisted further off the container the insert tube shaft will communicate with the atmosphere. This arrangement will prevent liquid from spraying or squirting out when the cap is first opened.

Having thus set forth the nature of the invention what is claimed herein is:

1. A liquid dispenser assembly for a container having liquid therein comprising: an insert plug having a passageway associated therewith being disposed within the inlet to said container, said passageway extending from said insert plug into said container toward the bottom thereof adapted for having liquid passing therethrough, a main dispenser body securely fastened with said container overlying said insert plug, liquid expulsion passageway means in communication with said insert passageway and terminating in said dispenser body at an end thereof comprising a liquid outlet port and having normally closed valve means at said end, first means coupling a first source of pressurized gas in said main dispenser body for operable communication with said liquid, actuatable button means mounted on said main body and connected with said valve means for causing said valve means to open said liquid outlet port whereupon liquid flows through said liquid passageway out from said container and said dispenser assembly, said button means operably associated with a valve assembly within said first means and causing said pressurized gas to assist in expulsion of liquid from said container upon actuation of said button means to open said valve means in expulsion of seal means between said insert plug and said main body for confining the liquid to said liquid passageway during expulsion thereof from said container and through said liquid dispenser, relief valve means mounted within said liquid dispenser body in communication with the interior of said container for exhausting pressurized gas from said container to the atmosphere in the event of excessive pressurization within said container, and second means coupling a second source of pressurized gas in said main body for cooperation with said first source to assist in expulsion of said liquid when needed.

2. The liquid dispenser assembly of claim 1 wherein said insert plug comprises an upper flange which overlies said inlet to said container and said flow passageway is centrally located within said plug, said seal means comprising a first seal means between said plug and said main body surrounding said flow passageway and second seal means at the end of said flange in operable sealing relation with said main body, and means for tightening said seal means.

3. The liquid dispenser of claim 1 wherein said actuatable means comprises a button confined for substantially up and down movement within a channel in said body and operably connected with said valve through a lever and cable means mounted within said main body.

4. The liquid dispenser of claim 1 including a flexible liner secured with an end of said insert plug surrounding said fluid passageway and disposed about the interior of said container for holding liquid therein.

5. The liquid dispenser assembly of claim 4 including gas passageway means in communication at one end with the interior of said flexible liner and extending through said insert plug.

6. The liquid dispenser assembly of claim 1 including means for providing a constant pressurized gas pressure to the contents of said container.

7. The liquid dispenser assembly of claim 1 including pressure regulating means for controlling the pressure of any external gas supplied to said container.

8. The liquid dispenser assembly of claim 1 wherein said actuatable means comprises a button-like member mounted for up and down movement within a channel in said main body, and said valve means being mounted for movement in a passageway which defines at least part of said liquid outlet.

9. The liquid dispenser assembly of claim 1 including spring means operably associated with said relief valve means for causing said valve to be disposed in a normally closed position.

* * * * *

UNITED STATES PATENT OFFICE

CERTIFICATE OF CORRECTION

PATENT NO. : 4,265,374

DATED : May 5, 1981

INVENTOR(S) : Adam Sebalos

It is certified that error appears in the above-identified patent and that said Letters Patent are hereby corrected as shown below:

Column 8, Line 36, cancel "in expulsion of" and add a comma --,-- after first word in line "means"

Signed and Sealed this

*Fourth* Day of *August 1981*

[SEAL]

*Attest:*

GERALD J. MOSSINGHOFF

*Attesting Officer*

*Commissioner of Patents and Trademarks*